US011519360B2

(12) United States Patent
Murugesan et al.

(10) Patent No.: US 11,519,360 B2
(45) Date of Patent: Dec. 6, 2022

(54) SYSTEMS AND METHODS FOR A CRANKCASE PRESSURE SENSOR

(71) Applicant: Powerhouse Engine Solutions Switzerland IP Holding GmbH, Zug (CH)

(72) Inventors: Ganesasubramanian Murugesan, Bangalore (IN); Todd Hayden, Prospect, PA (US)

(73) Assignee: Powerhouse Engine Solutions Switzerland IP Holding GmbH, Zug (CH)

( * ) Notice: Subject to any disclaimer, the term of this patent is extended or adjusted under 35 U.S.C. 154(b) by 0 days.

(21) Appl. No.: 17/219,462

(22) Filed: Mar. 31, 2021

(65) Prior Publication Data

US 2022/0010751 A1 Jan. 13, 2022

(30) Foreign Application Priority Data

Jul. 13, 2020 (IN) ..... IN202041029648

(51) Int. Cl.
*F02F 7/00* (2006.01)
*F01M 1/20* (2006.01)

(52) U.S. Cl.
CPC ..... *F02F 7/0068* (2013.01); *F01M 1/20* (2013.01); *F02F 7/0046* (2013.01); *F02F 2200/06* (2013.01)

(58) Field of Classification Search
CPC .... F02F 7/0068; F02F 7/0046; F02F 2200/06; F01M 1/20; F01M 13/04; F01M 13/0011; F01M 11/03; F02M 25/06; F02M 35/10222
See application file for complete search history.

(56) References Cited

U.S. PATENT DOCUMENTS

| | | | | |
|---|---|---|---|---|
| 8,534,257 | B2 | 9/2013 | Ogi et al. | |
| 8,596,240 | B2 | 12/2013 | Mavinahally et al. | |
| 10,871,129 | B1 * | 12/2020 | Jentz | F01M 13/04 |
| 2006/0118086 | A1 | 6/2006 | Schwulst et al. | |

(Continued)

FOREIGN PATENT DOCUMENTS

| | | | |
|---|---|---|---|
| CN | 101963110 | A | 2/2011 |
| CN | 207583505 | U | 7/2018 |

OTHER PUBLICATIONS

Eurasian Patent Office, Office Action Issued in Application No. 202092391, dated Nov. 17, 2021, 5 pages.

(Continued)

*Primary Examiner* — Syed O Hasan

(74) *Attorney, Agent, or Firm* — McCoy Russell LLP

(57) ABSTRACT

Various systems and methods are provided for reducing an amount of oil reaching a crankcase overpressure sensor. In one example, a system may include a cast wall protruding perpendicularly from an internal wall of crankcase, the cast wall at least partially surrounding a sensor port for a crankcase overpressure (COP) sensor, the sensor port fluidically coupled to the COP sensor via an internal passage; and a cover plate fixedly coupled to the cast wall, the cover plate parallel to the internal wall. In this way, oil may be blocked from reaching the COP sensor, while air may flow through the internal passage to the COP sensor.

14 Claims, 7 Drawing Sheets

(56) References Cited

U.S. PATENT DOCUMENTS

| | | | | |
|---|---|---|---|---|
| 2008/0210193 | A1* | 9/2008 | Neu | F02F 7/0007<br>123/196 CP |
| 2018/0087460 | A1 | 3/2018 | Pathan et al. | |
| 2021/0285348 | A1* | 9/2021 | Jentz | B60K 6/28 |

OTHER PUBLICATIONS

Intellectual Property India, Examination Report Issued in Application No. 202041029648, May 4, 2022, 7 pages.

* cited by examiner

SYSTEMS AND METHODS FOR A CRANKCASE PRESSURE SENSOR

CROSS REFERENCE TO RELATED APPLICATIONS

The present application claims priority to Indian Patent Application No. 202041029648, entitled "SYSTEMS AND METHODS FOR A CRANKCASE PRESSURE SENSOR", filed on Jul. 13, 2020. The entire contents of the above-listed application are hereby incorporated by reference for all purposes.

BACKGROUND

Technical Field

Embodiments of the subject matter disclosed herein relate to housings for engines.

Discussion of Art

An engine system may be equipped with a crankcase overpressure (COP) sensor for monitoring a pressure level in a crankcase of an engine (e.g., a crankcase pressure). For example, exhaust gases may escape from the cylinders during engine operation, causing the crankcase pressure to change. In order to reduce component degradation, a crankcase overpressure sensor may be used to monitor the crankcase pressure, and to adjust engine operating based on the sensed crankcase pressure. For example, if the crankcase pressure measured by the COP sensor exceeds a threshold, engine operation may be adjusted in order to reduce the crankcase pressure. As another example, COP sensor readings may be stored in memory, and may be used for diagnostic purposes.

However, in current engine systems, the COP sensor may be exposed to a lubricant such as engine oil during engine operation. Engine oil may be used to lubricate components of the crankcase of the engine, such that oil droplets may reach the COP sensor. For example, exposure to engine oil may alter COP sensor performance, which may reduce an accuracy of the sensed crankcase pressure. As an example, engine oil may splash onto a COP sensor, degrading sensor operation. Further, engine oil may distort a crankcase pressure reading differently during engine operation as an oil temperature changes. Overall, oil reaching the COP sensor may degrade COP sensor performance, which may in turn reduce overall engine efficiency and performance. Therefore, systems and methods for reducing an exposure of engine oil to a COP sensor are desired.

BRIEF DESCRIPTION

In one embodiment, a system comprises: a cast wall protruding perpendicularly from an internal wall of crankcase, the cast wall at least partially surrounding a sensor port for a crankcase overpressure (COP) sensor, the sensor port fluidically coupled to the COP sensor via an internal passage; and a cover plate fixedly coupled to the cast wall, the cover plate parallel to the internal wall.

BRIEF DESCRIPTION OF THE DRAWINGS

FIGS. 2-6 are drawn approximately to scale. However, other relative dimensions may be used, in other embodiments.

DETAILED DESCRIPTION

The following description relates to embodiments of a system for reducing oil exposure to a crankcase overpressure (COP) sensor of an engine. As one example, the engine may include a crankcase with an integrated front end housing, and the integrated front end housing may include a cast wall at least partially covering an opening (e.g., a sensor port), the opening leading through an internal passage with at least one joint to an inlet for a COP sensor. Further, the integrated front end housing may include a cover plate fixedly coupled to the cast wall by a plurality of fasteners, the cover plate parallel to a wall of the crankcase. The cover plate and cast wall may form a gap isolated from sources of engine oil. As such, air and other gases in the crankcase may pass through the gap and flow through the internal passage to the COP sensor, while oil may be at least partially blocked from flowing through the passage, reducing oil exposure to the COP sensor. Therefore, by including the cast wall and the cover plate, the crankcase may be provided with lubricating oil, without reducing an accuracy of the COP sensor. Further, by reducing the oil exposure to the COP sensor, sensor degradation may be reduced. In some examples, the internal passage may include at least one bend (e.g., a turn or corner), which may further decrease an amount of oil reaching the COP sensor.

Figure 1:
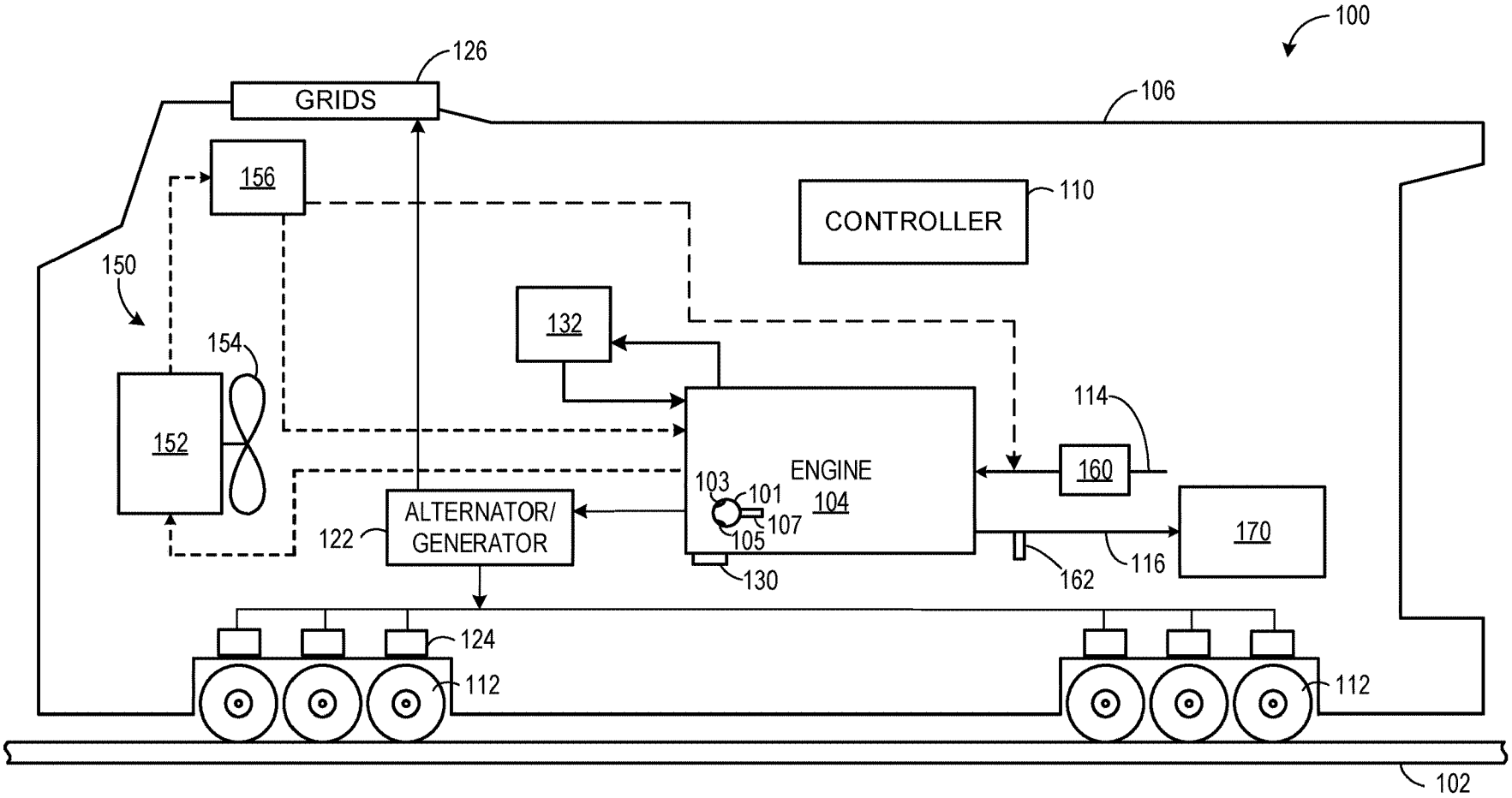
FIG. 1 shows a schematic diagram of a vehicle with an engine, according to an embodiment of the present disclosure.
Figure 2:
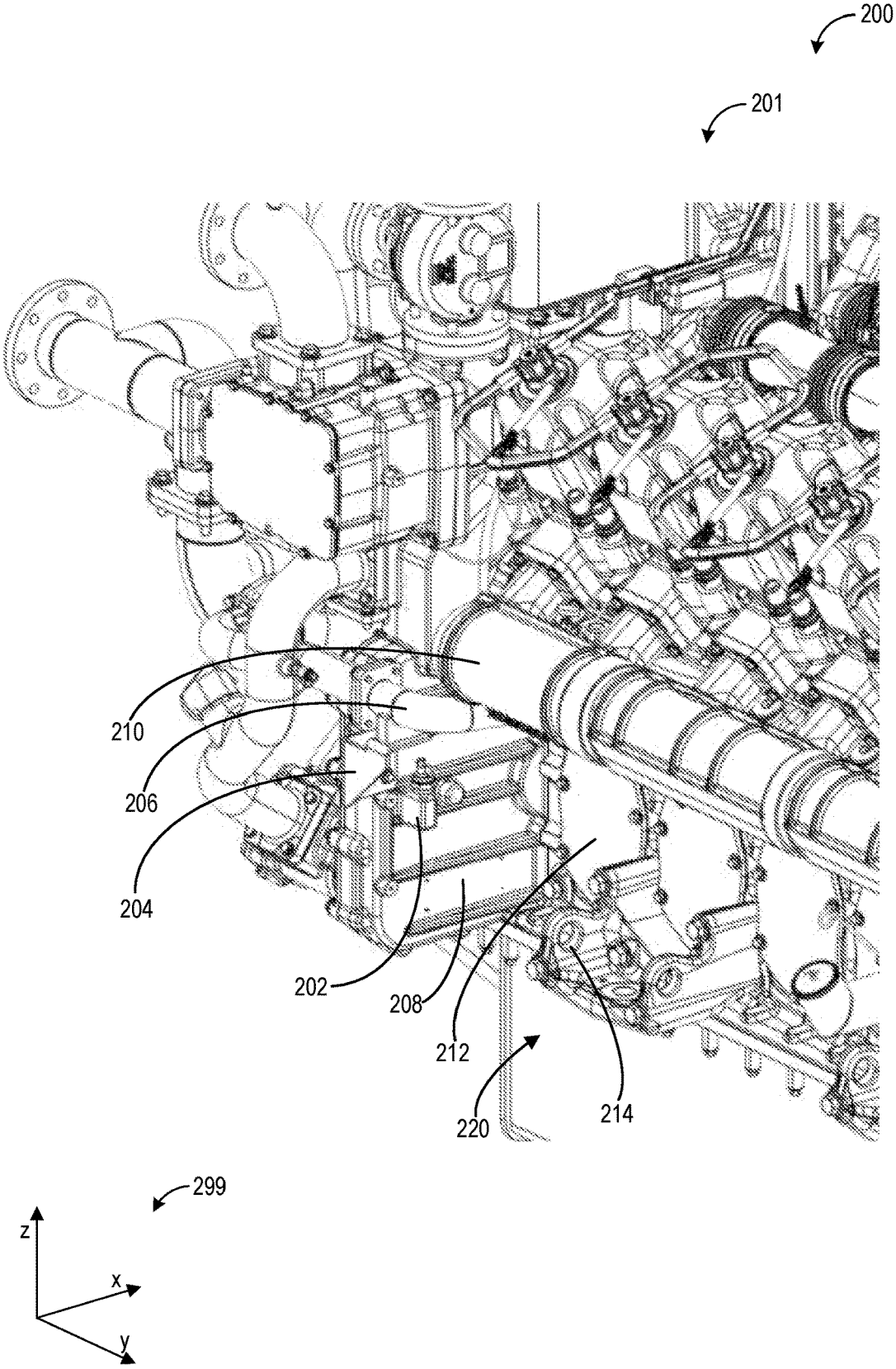
FIG. 2 shows a partial view of an engine, which may be the engine shown in FIG. 1, with a crankcase overpressure (COP sensor) coupled to an integrated front end housing of a crankcase of the engine.
Figure 3:
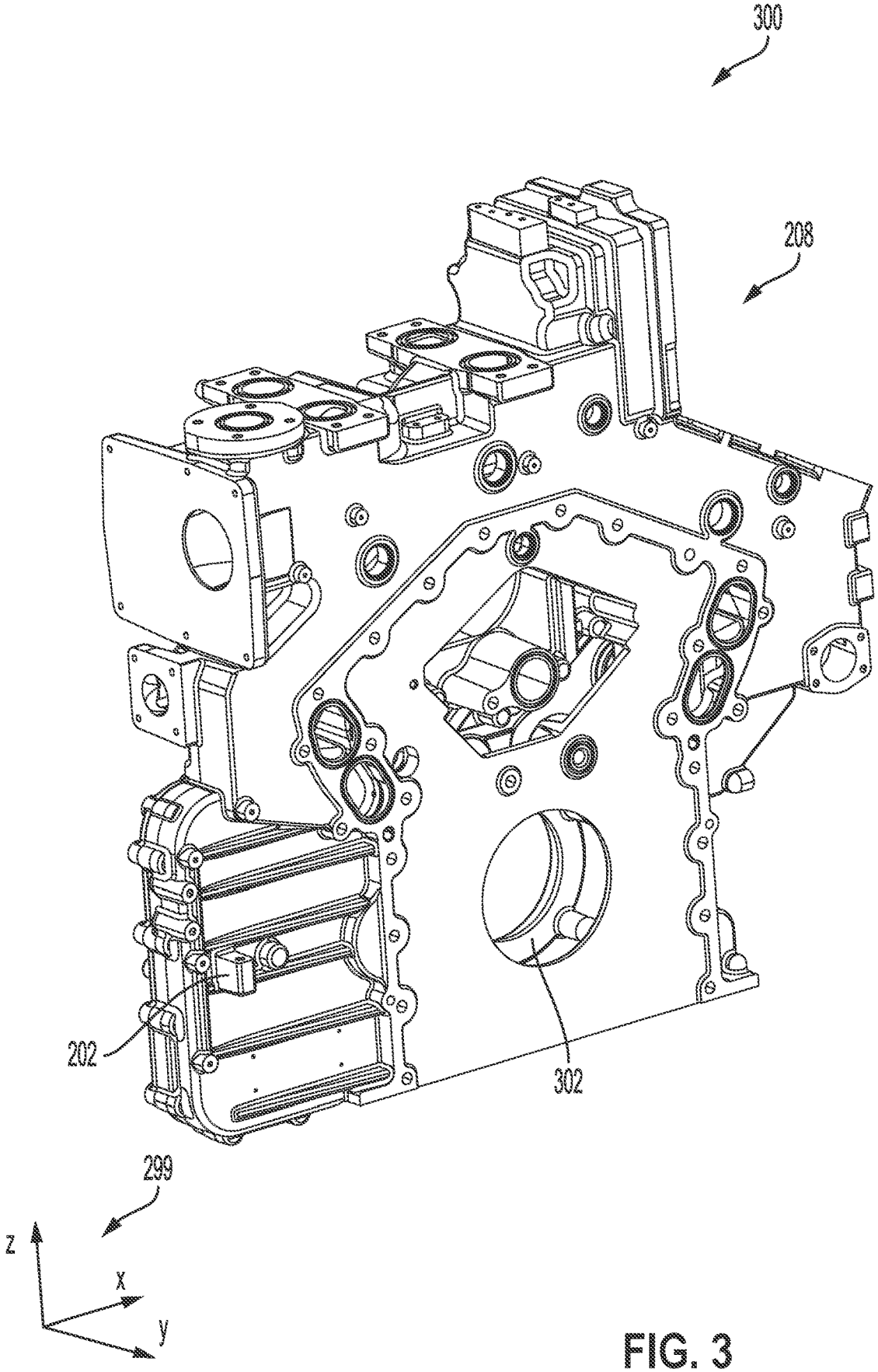
FIG. 3 shows an isolated view of the integrated front end housing shown in FIG. 2, including the COP sensor mounting provision.
Figure 4:
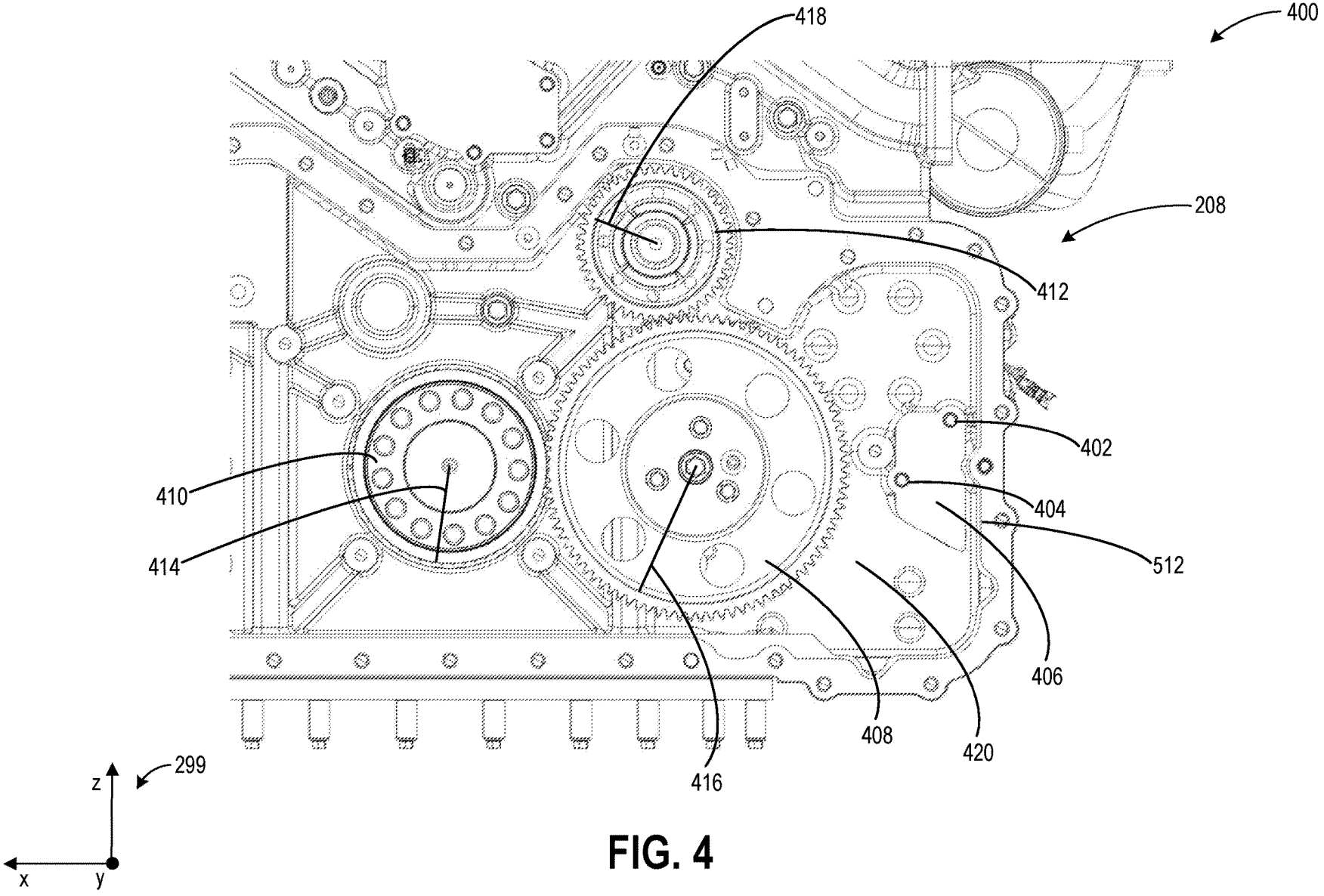
FIG. 4 shows a first partial cross section of the integrated front end housing shown in FIG. 2, including a cover plate for protecting a sensor port from oil.
Figure 5:
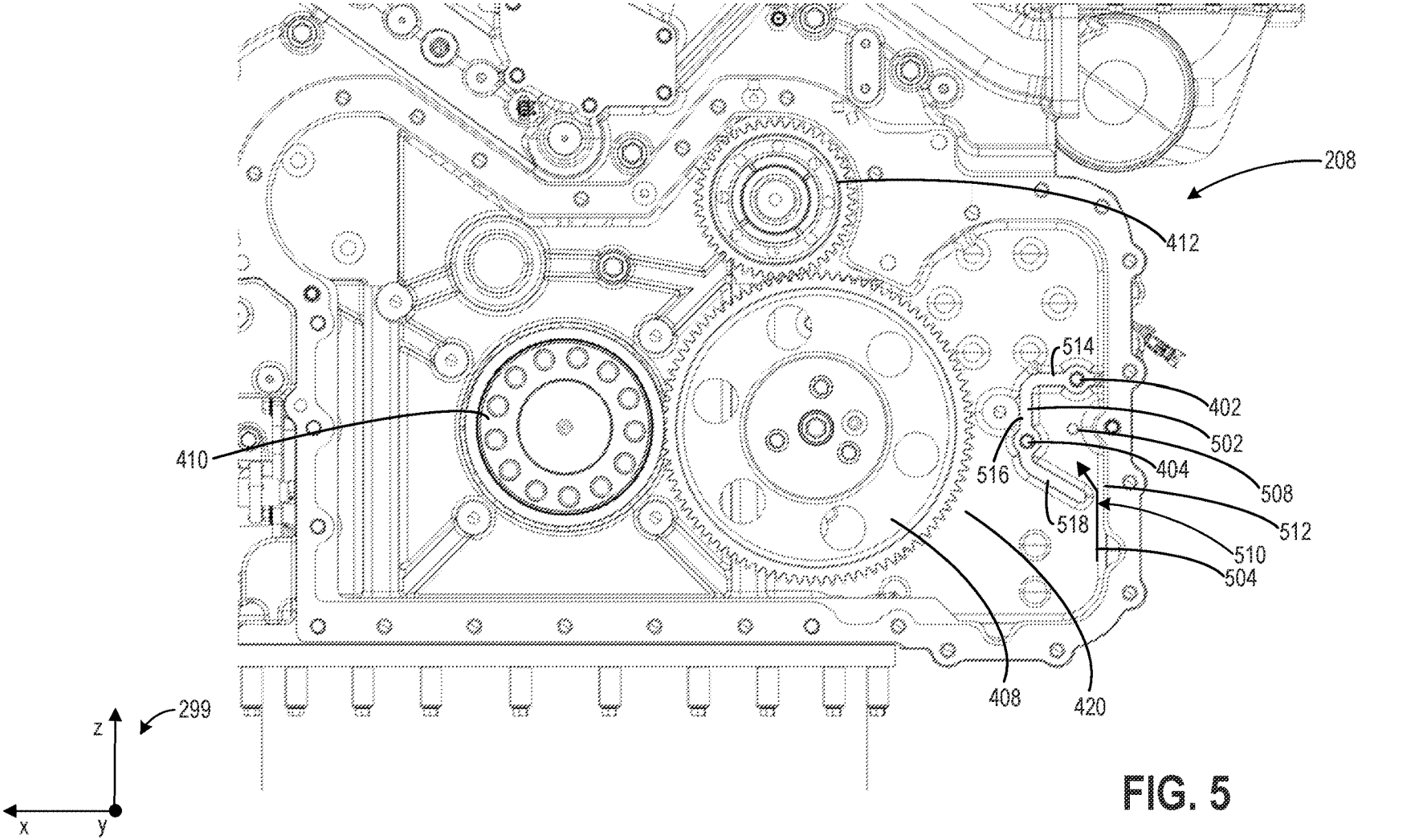
FIG. 5 shows a second partial cross-section of the integrated front end housing shown in FIG. 2, including the sensor port and a cast wall for protecting the sensor port from oil.
Figure 6:
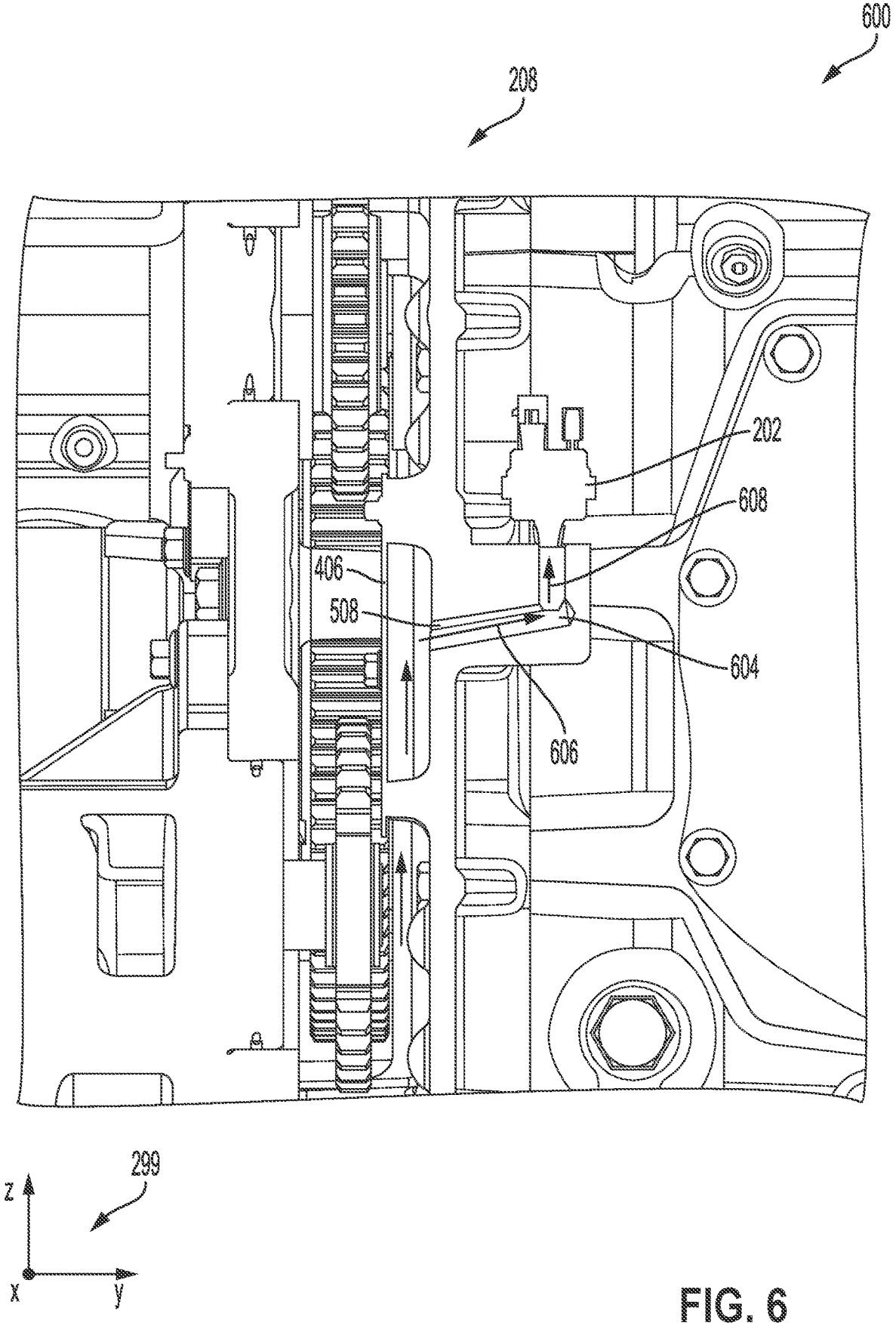
FIG. 6 shows a third partial cross-section of the integrated front end housing shown in FIG. 2, including an internal passage connecting the sensor port to the COP sensor inlet.
Figure 7:
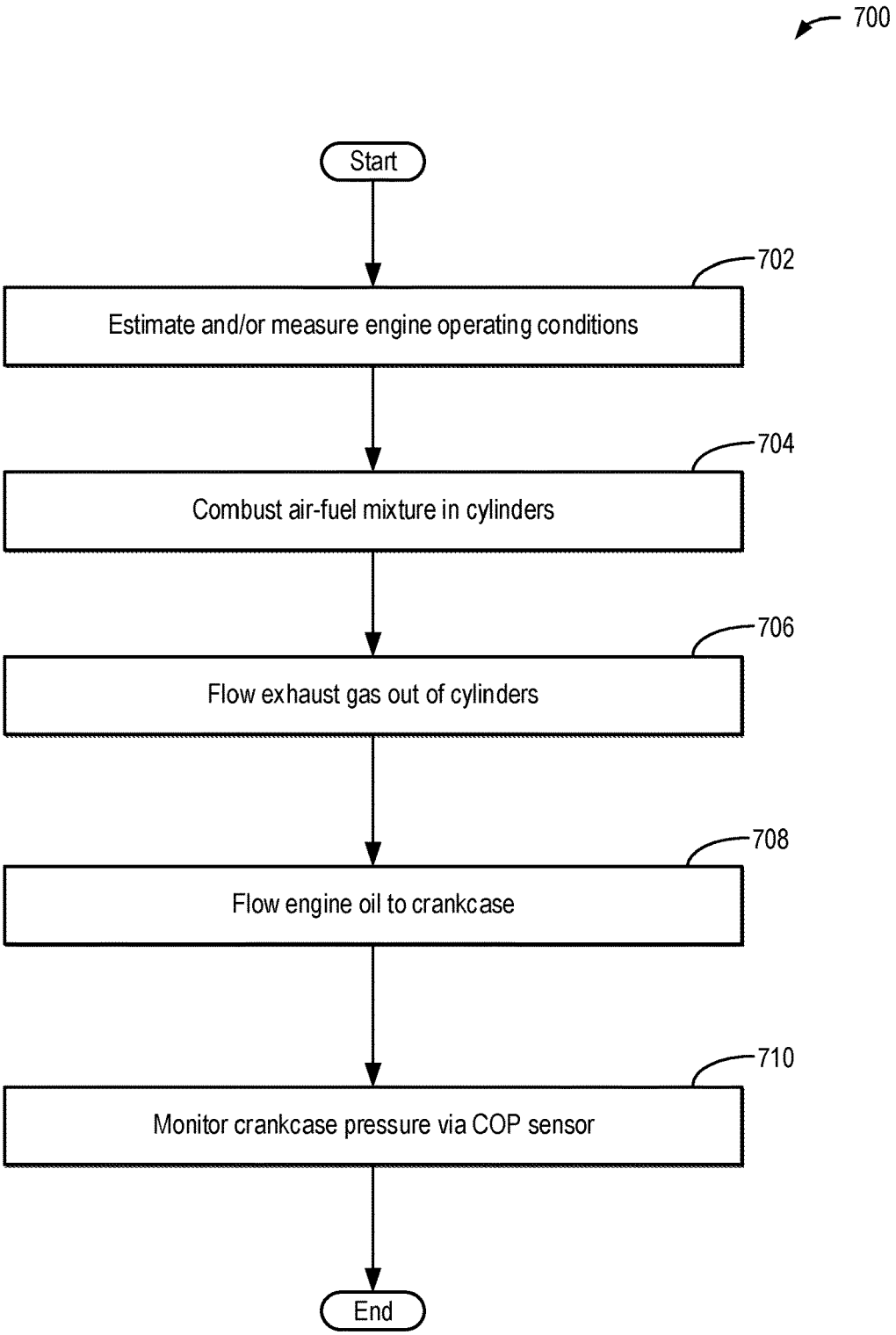
FIG. 7 shows a flowchart illustrating an example method for operating an engine with a COP sensor coupled to a crankcase of the engine.

In one example, a vehicle system (e.g., a rail vehicle system), such as shown in FIG. 1, may include an engine for combusting an air-fuel mixture, and may include a lubrication system for providing engine oil to various engine components. For example, the engine may include a crankcase, the crankcase comprising an integrated front housing and a COP sensor, as shown in FIG. 2. An isolated view of the integrated front end housing is shown in FIG. 3, while partial cross-sections of the integrated front end housing are shown in FIGS. 4-6. In particular, a sensor port leading to the COP inlet is protected from oil by a cover plate, shown in FIG. 4, and a cast wall, shown in FIG. 5. The cast wall and the cover plate may form a gap. Further, the sensor port flows air to the COP sensor inlet via an internal passage including at least one bend for reducing oil exposure, as shown in FIG. 6. FIG. 7 shows a flowchart of an example method for operating an engine, such as the engine shown in FIG. 1, and monitoring crankcase pressure via a COP sensor.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles (e.g., automobiles), mining equipment, marine vessels, rail vehicles, and other off-highway vehicles (OHV). For clarity of illustration, a rail vehicle such as a locomotive may be provided as an example of a mobile platform supporting a system incorporating an embodiment of the disclosure. For example, the mobile platform may be a shunter locomotive with a diesel engine, as will be elaborated below.

FIG. 1 shows an embodiment of a system in which a crankcase overpressure (COP) sensor may be installed. Specifically, FIG. 1 shows a block diagram of an embodiment of a vehicle system 100, herein depicted as a locomotive 106 configured to run on a road 102 via a plurality of wheels 112. As depicted, the locomotive 106 includes an engine 104. The engine includes a plurality of cylinders 101 (only one representative cylinder shown in FIG. 1) that each include at least one intake valve 103, at least one exhaust valve 105, and at least one fuel injector 107. Each intake valve, exhaust valve, and fuel injector may include an actuator that may be actuated via a signal from a controller 110 of the engine 104. A COP sensor 130 may be coupled to a component of the engine 104. For example, the COP sensor may be coupled to an integrated front end housing of engine 104. In other non-limiting embodiments, the engine 104 may be a stationary engine, such as in a power-plant application, or an engine in a marine vessel or other off-highway vehicle propulsion system as noted above.

The engine 104 receives intake air for combustion from an intake passage 114. The intake passage 114 includes an air filter 160 that filters air from outside of the locomotive. Exhaust gas resulting from combustion in the engine is supplied to an exhaust passage 116. For example, exhaust passage 116 may include an exhaust gas sensor 162, which may monitor a temperature and/or an air-fuel ratio of the exhaust gas. Exhaust gas flows through the exhaust passage 116 and an exhaust system of the locomotive. For example, exhaust passage 116 may be coupled to a spark arrestor in order to decrease sparks and/or carbon deposits in the exhaust and a muffler in order to reduce unwanted exhaust noise.

The vehicle system may further include an aftertreatment system coupled in the exhaust passage 116. In one embodiment, the aftertreatment system may include one or more emission control devices. Such emission control devices may include a selective catalytic reduction (SCR) catalyst, a three-way catalyst, a $NO_x$ trap, or various other devices or exhaust aftertreatment systems. In another embodiment, the aftertreatment system may additionally or alternatively include a diesel oxidation catalyst (DOC) and a diesel particulate filter (DPF).

Further, combustion in the cylinder(s) drives rotation of a crankshaft (not shown). In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally or alternatively combust fuel including gasoline, kerosene, natural gas, biodiesel, or other petroleum distillates of similar density through compression ignition (and/or spark ignition).

As depicted in FIG. 1, the engine is coupled to an electric power generation system that includes an alternator/generator 122. For example, the engine is a diesel and/or natural gas engine that generates a torque output that is transmitted to the alternator/generator 122, which is mechanically coupled to the crankshaft, as well as to at least one of the plurality of wheels 112 to provide motive power to propel the locomotive. The alternator/generator 122 produces electrical power that may be stored and applied for subsequent propagation to a variety of downstream electrical components. In one example, the alternator/generator 122 may be coupled to an electrical system 126. The electrical system 126 may include one or more electrical loads configured to run on electricity generated by the alternator/generator 122, such as vehicle headlights, a cabin ventilation system, and an entertainment system, and may further include an energy storage device (e.g., a battery) configured to be charged by electricity generated by the alternator/generator 122. In some examples, the vehicle may be a diesel electric vehicle, and the alternator/generator 122 may provide electricity to one or more electric motors to drive the wheels 112.

As depicted in FIG. 1, the vehicle system further includes a cooling system 150 (e.g., an engine cooling system). The cooling system 150 circulates coolant through the engine 104 to absorb waste engine heat and distribute the heated coolant to a heat exchanger, such as a radiator 152 (e.g., a radiator heat exchanger). In one example, the coolant may be water. A fan 154 may be coupled to the radiator 152 in order to maintain an airflow through the radiator 152 when the vehicle is moving slowly or stopped while the engine 104 is running. In some examples, fan speed may be controlled by the controller 110. Coolant that is cooled by the radiator 152 may enter a tank (not shown). The coolant may then be pumped by a water, or coolant, pump 156 back to the engine or to another component of the vehicle system.

The controller 110 may be configured to control various components related to the locomotive vehicle system. As an example, various components of the vehicle system may be coupled to the controller 110 via a communication channel or data bus. In one example, the controller 110 includes a computer control system. The controller 110 may additionally or alternatively include a memory holding non-transitory computer readable storage media (not shown) including code for enabling on-board monitoring and control of locomotive operation. In some examples, the controller 110 may include more than one controller each in communication with one another, such as a first controller to control the engine and a second controller to control other operating parameters of the vehicle (such as engine load, engine speed, brake torque, etc.). The first controller may be configured to control various actuators based on output received from the second controller and/or the second controller may be configured to control various actuators based on output received from the first controller.

The controller 110 may receive information from a plurality of sensors, such as the COP sensor 130, and may send control signals to a plurality of actuators. The controller 110, while overseeing control and management of the engine and/or vehicle, may be configured to receive signals from a variety of engine sensors, as further elaborated herein, in order to determine operating parameters and operating conditions, and correspondingly adjust various engine actuators to control operation of the engine and/or vehicle. For example, the controller 110 may receive signals from various engine sensors including, but not limited to, engine speed, engine load, intake manifold air pressure, boost pressure, exhaust pressure, ambient pressure, ambient temperature, exhaust temperature, particulate filter temperature, particulate filter back pressure, engine coolant pressure, or the like. Additional sensors, such as coolant temperature sensors, may be positioned in the cooling system. Correspondingly, the controller 110 may control the engine and/or the vehicle by sending commands to various components such as the one or more electric motors 124, the alternator/generator 122, fuel injectors 107, valves, coolant pump 156, or the like. For example, the controller 110 may control the operation of a restrictive element (e.g., such as a valve) in the engine cooling system. Other actuators may be coupled to various locations in the vehicle.

The COP sensor 130 may be a pressure sensor for measuring air pressure in or near the crankcase of the engine 104. For example, COP sensor may include a component for converting air pressure into an electrical signal, such as one of resistance, electrical current, capacitance, inductance, voltage, etc. For example, the COP sensor may include at least one of a piezoresistive strain gauge, a capacitive pressure sensor, an electromagnetic pressure sensor, a piezoelectric pressure sensor, an optical pressure sensor, and a potentiometric pressure sensor. As one non-limiting example, the COP sensor may include a piezoresistive material, such as polycrystalline silicon, that changes resistance to the flow of electric current in response to a mechanical caused by a change in air pressure. Therefore, changes in crankcase pressure may be converted into electrical signals and monitored by the controller 110. In particular, controller 110 may include executable instructions stored in non-transitory memory that cause the controller 110 to monitor for a crankcase overpressure state, in which the crankcase pressure exceeds a pre-determined threshold crankcase pressure. A crankcase overpressure state may reduce engine efficiency and increase an incidence of component degradation. By including a COP sensor in an engine system, crankcase pressure may be monitored in order to reduce an incidence of the crankcase overpressure state, and in order to perform engine diagnostics.

FIGS. 2-6 provide embodiments of a crankcase and integrated front end housing of an engine that may be included in a vehicle system, such as the vehicle system 100 of FIG. 1. FIGS. 2-6 will be described collectively, with like components numbered the same and not reintroduced between figures. FIGS. 2-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. Further, reference axes 299 are included in each FIGS. 2-6 in order to compare the views and relative orientations described below. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. FIGS. 2-6 are drawn approximately to scale, although other dimensions or relative dimensions may be used.

Turning now to FIG. 2, view 200 shows a partial view of an engine 201, including a crankcase 220. For example, engine 201 may be used as engine 104 of FIG. 2. The view 200 shown in FIG. 2 shows the engine 201 rotated about the z-axis such that foreshortened projections of each of the x- and y-axes are shown. Engine 201 includes a plurality of cylinders for combusting air and fuel in order to drive a crankshaft (not shown in FIG. 2). Further, air may be provided to the cylinders via an intake manifold 210. The engine temperature may be reduced via coolant provided by a low temperature water pipe 206. As shown, the low temperature water pipe 206 is supported by a low temperature water pipe bracket 204. The crankcase 220 may encase the crankshaft, and an oil pan of the crankcase (not shown) may provide engine oil for lubricating the crankshaft. The crankcase 220 also includes a crankcase side door 212 and an engine mount bracket 214. For example, the engine mount bracket 214 may be used to mount the engine 201 to a component of a vehicle.

Further, crankcase 220 includes an integrated front end housing 208. For example, the integrated front end housing may house a plurality of gears for converting crankshaft rotation, such as an idler gear and a fuel pump drive gear (shown in FIGS. 4 and 5). A COP sensor 202 is coupled to the integrated front end housing in order to monitor the crankcase pressure. For example, COP sensor 202 may be COP sensor 130 shown in FIG. 1. Additional views of the integrated front end housing 208 are shown in FIGS. 3-6.

Next, FIG. 3 shows an isolated view 300 of integrated front end housing 208. As shown by references axes 299, view 300 shows a rotated view of the integrated front end housing 208. As elaborated above with respect to FIG. 2, the integrated front end housing 208 is a component of crankcase 220. Further, the integrated front end housing 208 includes a plurality of inlets for coolant, and may house gears for converting crankshaft rotation. The crankshaft may pass through a crankshaft opening 302, and may engage with one or more gears in the integrated front end housing 208.

Next, FIG. 4 shows a first partial cross-sectional view 400 of integrated front end housing 208. As shown by reference axes 299, view 400 is an x-z planar view, and the cut plane for the cross section is parallel to the x-z plane. In particular, view 400 shows internal components of the integrated front end housing 208, which may engage with the crankshaft in order to convert crankshaft rotation. For example, the crankshaft may be directly coupled to a crank gear 410, so that the crank gear 410 rotates with the crankshaft. Teeth of the crank gear 410 may mesh with teeth of an idler gear 408, so that the crank gear 410 transmits rotation to the idler gear 408.

Stated differently, teeth of the crank gear 410 are in contact with teeth of the idler gear 408, so that crank gear 410 rotation causes the idler gear 408 to rotate in proportion to rotation of the crank gear 410. As shown, the crank gear 410 has a crank gear radius 414, and the idler gear 408 has an idler gear radius 416. The crank gear radius 414 is smaller than the idler gear radius 416, as shown. As such, the idler gear 408 may rotate more slowly relative to the crank gear 410, in order to convert high speed crank gear rotation to lower speed idler gear rotation. Further, the idler gear 408 meshes with a fuel pump drive gear 412, which may drive a fuel pump of the engine. For example, a speed with which the fuel pump drive gear rotates may determine when fuel injectors of the engine inject fuel for the cylinders. As shown, the fuel pump drive gear 412 is a fuel pump drive gear radius 418, which may be smaller than each of the idler gear radius 416 and the crank gear radius 414. The fuel pump drive gear 412 may rotate more quickly than the idler gear 408, as the idler gear 408 transmits rotational speed to the fuel pump drive gear 412 via gear teeth. Each of the crank gear 410, the idler gear 408, and the fuel pump drive gear 412 may be rotatably mounted to a housing wall 420 of the integrated front end housing 208. Each of the crank gear radius 414, the idler gear radius 416, and the fuel pump drive gear radius 418 may be selected based on desired relative rotational speeds of the gears. Further, a number of gear teeth for each gear may be selected based on the desired relative rotational speeds of the gears.

In order to maintain gear rotation and to reduce component degradation, components of the integrated front end housing, such as the crankshaft and the gears (e.g., the idler gear 408, the crank gear 410, and the fuel pump drive gear 412) may be provided with engine oil from a sump of the crankcase. Engine oil may decrease friction between engine components, and may provide cooling, in order to reduce component degradation and increase engine efficiency. As shown in view 400, a cover plate 406 is coupled to the integrated front end housing 208 in order to shield a COP sensor port (e.g., a COP sensor port 508, shown in FIG. 5) from engine oil. The cover plate 406 is coupled to a cast wall (e.g., a cast wall 502 shown in FIG. 5) via a first fastener 402 and a second fastener 404. For example, each of the first fastener 402 and the second fastener 404 may be rivets, screws, bolts, and the like. The cover plate 406 may be a planar metal sheet parallel to the x-z plane, and may be configured to align with the cast wall 502 (e.g., shown in FIG. 5). For example, the cover plate 406 may extend from the cast wall 502 to an edge 512 of the housing wall 420.

Next, FIG. 5 shows a second partial cross-sectional view 500 of integrated front end housing 208. For example, the view 500 may be substantially identical to view 400 shown in FIG. 4. As such, like components may be numbered the same and will not be reintroduced. Similar to view 400, view 500 is an x-z planar view, with a cut plane parallel to the x-z plane. However, view 500 of FIG. 5 shows an internal view of the integrated front end housing 208 without the cover plate 406 of FIG. 4, so that the cast wall 502 and the COP sensor port 508 are shown. The cast wall may be integrally formed with housing wall 420 of the integrated front end housing 208. The cast wall 502 may further block oil from reaching the COP sensor port 508. As shown, a gap 510 between the cast wall 502 and the edge 512 of the housing wall 420 may provide a flow path 504, through which air may flow to the COP sensor port 508. For example, the COP sensor port 508 may direct air to a COP sensor (not shown in FIG. 5) for pressure sensing.

Specifically, and as shown in FIG. 5, the cast wall 502 may include a first linear section 514 (e.g., protruding perpendicularly from the housing wall 420), a second linear section 516, and a third linear section 518, the third linear section 518 and the edge 512 of the housing wall 420 being separated by the gap 510. As further shown, the first linear section 514 may be perpendicular to the second linear section 516 and an angle between the second linear portion 516 and the third linear portion 518 may be less than 180 degrees.

Next, FIG. 6 shows a third partial cross-sectional view 600 of integrated front end housing 208. As shown by references axes 299, view 600 is a y-z planar view, with a cut plane parallel to the y-z plane. View 600 shows an internal passage 604 connecting the COP sensor port 508 to COP sensor 202. For example, air may flow to COP sensor port 508 via flow path 504, and may continue through the internal passage 604 to the COP sensor 202, as shown by flow path arrows. For example, the cast wall 502 and the cover plate 406 may prevent engine oil from reaching the COP sensor port 508. Further, because internal passage 604 includes a bend, any oil that reaches the COP sensor port 508 may be blocked from reaching the COP sensor 202. For example, as shown in FIG. 6, internal passage 604 includes a first portion 606 and a second portion 608. The first portion 606 may form a positive angle less than 90 degrees with the x-axis of reference axes 299, and the second portion 608 may be parallel with the y-axis of reference axes 299. As such, an angle between the first portion 606 and the second portion 608 may be less than 180 degrees, so that the join between the first portion 606 and the second portion 608 may reduce an amount of oil reaching the COP sensor 202.

In this way, an amount of oil reaching the COP sensor of an engine may be reduced. For example, by including a cast wall and a cover plate, oil may be blocked from reaching a COP sensor port, while air may flow to the COP sensor via a flow path. Reducing an amount of oil reaching the COP sensor may increase an accuracy of the COP sensor due to oil contamination, and may reduce an incidence of COP sensor degradation. Therefore, the COP sensor may monitor crankcase pressure during engine operation. For example, pressurized air from the crankcase may flow to the COP sensor, while oil may not reach the COP sensor due to the cover plate and the cast wall.

Next, FIG. 7 provides a method 700 for operating an engine and monitoring a crankcase pressure via a COP sensor. The COP sensor may be installed in an integrated front end housing of an engine, such as integrated front end housing 208 shown in FIGS. 2-6. For example, the engine may combust a mixture of air and fuel in a plurality of cylinders to generate power, which may drive rotation of a crankshaft. Hot exhaust gas may flow out of the cylinders to an exhaust system. The crankshaft may be housed in a crankcase, which may include an oil pan for lubricating components of the engine. However, during engine operation, a portion of the hot exhaust gases may escape the cylinders into the crankcase, which may increase a pressure in the crankcase. Therefore, the COP sensor may be included in the engine, and may be coupled to an integrated front housing of the engine. The integrated front end housing may include a cast wall and a cover plate in order to prevent oil in the crankcase from reaching the COP sensor. At least portions of method 700 may be executed by a controller, such as the controller 110 shown in FIG. 1, based on instructions stored in non-transitory memory.

At 702, method 700 includes estimating and/or measuring engine operating conditions. For example, the controller may monitor and/or estimate various engine operating conditions, such as engine temperature and a requested power level in order to control engine operation. For example, the controller may receive a signal from an operator requesting additional engine power. As another example, the controller may receive a signal from an operator requested less engine power.

At 704, method 700 includes combusting an air-fuel mixture in cylinders of the engine in order to generate power. For example, fuel from a fuel system may be delivered via fuel injectors, where the fuel is mixed with air, the amount of air controlled by adjusting an opening of an intake valve. In one example, the amount of fuel to be delivered is empirically determined and stored in a predetermined lookup table or function, which may be indexed to engine operating conditions, such as engine speed and load, among other engine operating conditions (e.g., such as a desired air-fuel ratio). The controller may then determine a pulse-width of a control signal to send to the fuel injector actuator corresponding to the determined amount of fuel to be delivered. The resulting air-fuel mixture may be ignited (e.g., via compression ignition), generating power via expanding exhaust gases.

At 706, method 700 includes flowing exhaust gas out of the cylinders. For example, the exhaust gas may be released via an opening of an exhaust valve. In one example, exhaust gas may flow through an exhaust gas manifold, and exit the vehicle via an exhaust system. For example, the exhaust system may include a muffler and other aftertreatment devices, such as a catalyst. However, a small fraction of the exhaust gas may escape from the cylinders and flow into the crankcase, which may change the crankcase pressure. As an example, the crankcase pressure may increase.

At 708, method 700 includes flowing engine oil to the crankcase. For example, a lubrication system of the engine may include a pump, and oil may be pumped to the crankcase in order to provide lubrication to crankcase components. Engine oil may be provided to components of the crankcase in order to lubricate and cool components. Further, because a cast wall and a cover plate at least partially surround a COP sensor port, oil may be blocked from reaching the COP sensor.

At 710, method 700 includes monitoring the crankcase pressure via the COP sensor. For example, the COP sensor is communicatively coupled to the controller, and may continuously or periodically transmit a signal to the controller corresponding to a pressure level in the crankcase. The controller may convert the signal from the COP sensor to a pressure value, and may adjust engine operation based on the crankcase pressure. For example, if the crankcase pressure is in a n overpressure condition (e.g., the crankcase pressure exceeds a threshold pressure), the controller may adjust engine operation in order to reduce the crankcase pressure. As another example, the controller may output a malfunction code, which may be stored in non-volatile memory, and further may be displayed to a user. For example, because the cover plate and the cast wall reduce an amount of oil reaching the COP sensor, COP sensor accuracy may be increased. Method 700 may then end.

In this way, an accuracy of a COP sensor of an engine may be increased via reducing an amount of oil reaching the COP sensor during engine operation. For example, by including a cast wall and a cover plate, the cover plate fixedly coupled to the cast wall, oil may be blocked from reaching a COP sensor port. For example, the cast wall may be integrally formed with an integrated front end housing of the engine, and may be positioned to block engine oil from components of the integrated front end housing, such as gears. Further, the cover plate may be fixedly coupled to the cast wall, and may further block engine oil from reaching a COP sensor, the COP sensor located under the cover plate and proximate to the cast wall. A flow path may allow air to flow to the COP sensor port, while engine oil may be at least partially blocked. Further, the COP sensor port may be fluidically coupled to the COP sensor via an internal passage, the internal passage including a bend. Overall, an amount of oil reaching the COP sensor may be reduced. By reducing the amount of oil reaching the COP sensor, COP sensor accuracy may be increased, and COP sensor degradation may be reduced. For example, increasing COP sensor accuracy may allow a controller of the engine to more accurately monitor a crankcase pressure, which may increase engine performance.

The technical effect of including a cover plate and a cast wall in an integrated front end housing of an engine is that an amount of engine oil reaching a COP sensor of an engine may be reduced, while air may flow to the COP sensor for pressure sensing. For example, the cover plate and the cast wall may block engine oil from reaching a COP sensor port, while air may flow to the COP sensor port via a flow path formed by the cast wall and an edge of an internal wall of the integrated front end housing.

As an example, a method comprises: a cast wall protruding perpendicularly from an internal wall of a crankcase of an engine, the cast wall at least partially surrounding a sensor port for a crankcase overpressure (COP) sensor, the sensor port fluidically coupled to the COP sensor via an internal passage; and a cover plate fixedly coupled to the cast wall, at least a portion of the cover plate parallel to the internal wall. In the preceding example, additionally or optionally, the cast wall includes a first linear section, a second linear section, and a third linear section, the first linear section perpendicular to the second linear section, and an angle between the second linear section and the third linear section less than 180 degrees. In one or both of the preceding examples, additionally or optionally, the cover plate extends from the cast wall to an edge of the internal wall. In any or all of the preceding examples, additionally or optionally, the third linear section and the edge of the internal wall are separated by a gap. In any or all of the preceding examples, additionally or optionally, the internal passage includes a first portion and a second portion, an angle between the first portion of the internal passage and the second portion of the internal passage less than 180 degrees. In any or all of the preceding examples, additionally or optionally, the second portion of the internal passage is parallel to the internal wall of the crankcase. In any or all of the preceding examples, additionally or optionally, a plurality of gears is rotatably coupled to the internal wall, the plurality of gears including a crank gear, an idler gear, and a fuel pump drive gear. In any or all of the preceding examples, additionally or optionally, the crank gear is coupled to a crankshaft of the engine. In any or all of the preceding examples, additionally or optionally, the cast wall is integrally formed with the internal wall of the crankcase.

As another example, a system comprises: a crankcase encasing cylinders of an engine, the crankcase including an integrated front end housing; a crankcase overpressure (COP) sensor coupled to the crankcase; a sensor port positioned in an internal wall of the integrated front end housing, the sensor port fluidically coupled to the COP sensor; a cast wall integrally formed with the internal wall, the cast wall at least partially surrounding the sensor port; and a cover plate fixedly coupled to the cast wall, at least a portion of the cover plate parallel to the internal wall. In the preceding example, additionally or optionally, an internal passage is positioned between the sensor port and the COP sensor, the internal passage including at least one bend. In one or both of the preceding examples, additionally or optionally, the integrated front end housing houses a plurality of gears, the plurality of gears rotatably coupled to the internal wall of the integrated front end housing, and the plurality of gears including an idler gear, a crank gear, and a fuel pump drive gear, the crank gear coupled to a crankshaft of the engine, the crankshaft perpendicular to the internal wall of the integrated front end housing. In any or all of the preceding examples, additionally or optionally, the cover plate extends from the cast wall to an edge of the internal wall of the integrated front end housing. In any or all of the preceding examples, additionally or optionally, the cover plate is fixedly coupled to the cast wall via a first fastener and a second fastener, each of the first fastener and the second fastener extending perpendicular to the internal wall. In any or all of the preceding examples, additionally or optionally, the COP sensor is communicatively coupled to a controller of the engine.

As yet another example, a method comprises: monitoring a crankcase pressure in a crankcase of an engine based on a signal from a crankcase overpressure (COP) sensor, the COP sensor coupled to an integrated front end housing of the crankcase, and a sensor port of the COP sensor at least partially surrounded by a cast wall and a cover plate. In the preceding example, the method additionally or optionally further comprises: responsive to the crankcase pressure exceeding a threshold crankcase pressure, determining a crankcase overpressure event and adjusting at least one engine operating condition. In one or both of the preceding examples, additionally or optionally, the cast wall is integrally formed with an internal wall of the integrated front end housing. In any or all of the preceding examples, additionally or optionally, at least a portion of the cover plate is parallel to the internal wall and fixedly coupled to the cast wall via a first fastener and a second fastener. In any or all of the preceding examples, additionally or optionally, the sensor port is fluidically coupled to the COP sensor via an internal passage, the internal passage including at least one bend.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising: a cast wall protruding perpendicularly from an internal wall of a crankcase of an engine, the cast wall at least partially surrounding a sensor port for a crankcase overpressure (COP) sensor, the sensor port fluidically coupled to the COP sensor via an internal passage; and a cover plate fixedly coupled to the cast wall via at least two fasteners, at least a portion of the cover plate parallel to the internal wall, extending from the cast wall to an edge of the internal wall, each of the fasteners extending perpendicular to the internal wall.

2. The system of claim 1, wherein the cast wall includes a first linear section, a second linear section, and a third linear section, the first linear section is perpendicular to the second linear section, and an angle between the second linear section and the third linear section is less than 180 degrees.

3. The system of claim 1, wherein the internal passage includes a first portion and a second portion, an angle between the first portion of the internal passage and the second portion of the internal passage less than 180 degrees.

4. The system of claim 3, wherein the second portion of the internal passage is parallel to the internal wall.

5. The system of claim 1, wherein a plurality of gears is rotatably coupled to the internal wall, the plurality of gears including a crank gear, an idler gear, and a fuel pump drive gear.

6. The system of claim 5, wherein the crank gear is coupled to a crankshaft of the engine.

7. The system of claim 1, wherein the cast wall is integrally formed with the internal wall of the crankcase.

8. The system of claim 1, wherein a plurality of gears is rotatably coupled to the internal wall, the plurality of gears including a crank gear, an idler gear, and a fuel pump drive gear, wherein the cover plate is on an opposite side of the idler gear from the crank gear when viewed from a front of the engine, wherein the cast wall part of an integrated front end housing.

9. A system, comprising:

a cast wall protruding perpendicularly from an internal wall of a crankcase of an engine, the cast wall at least partially surrounding a sensor port for a crankcase overpressure (COP) sensor, the sensor port fluidically coupled to the COP sensor via an internal passage; and a cover plate fixedly coupled to the cast wall, at least a portion of the cover plate parallel to the internal wall, wherein the cast wall includes a first linear section, a second linear section, and a third linear section, the first linear section perpendicular to the second linear section, and an angle between the second linear section and the third linear section less than 180 degrees, wherein the cover plate extends from the cast wall to an edge of the internal wall, and wherein the third linear section and the edge of the internal wall are separated by a gap.

10. A method, comprising:

monitoring a crankcase pressure in a crankcase of an engine based on a signal from a crankcase overpressure (COP) sensor, the COP sensor coupled to an integrated front end housing of the crankcase, and a sensor port of the COP sensor at least partially surrounded by a cast wall and a cover plate, wherein the cast wall is vertically centered with an idler gear and a crank gear, and the cover plate is on an opposite side of the idler gear from the crank gear when viewed from a front of the engine.

11. The method of claim 10, further comprising, responsive to the crankcase pressure exceeding a threshold crankcase pressure, determining a crankcase overpressure event and adjusting at least one engine operating condition.

12. The method of claim 10, wherein the cast wall is integrally formed with an internal wall of the integrated front end housing.

13. The method of claim 12, wherein at least a portion of the cover plate is parallel to the internal wall and fixedly coupled to the cast wall via a first fastener and a second fastener.

14. The method of claim 10, wherein the sensor port is fluidically coupled to the COP sensor via an internal passage, the internal passage including at least one bend.

* * * * *